US006152067A

United States Patent [19]

Mathison

[11] Patent Number: 6,152,067

[45] Date of Patent: Nov. 28, 2000

[54] MEDICATION DOSAGE REMINDER DEVICE

[76] Inventor: Ronald Grant Mathison, #10, 7235 18th Avenue, Burnaby, British Columbia, Canada, V3N 1H4

[21] Appl. No.: 09/110,380

[22] Filed: Jun. 30, 1998

[51] Int. Cl.[7] ..... G09F 11/04

[52] U.S. Cl. ..... 116/308; 116/309; 206/459.1

[58] Field of Search ..... 428/66.5, 66.6; 40/495; 206/459.1, 459.5; 215/230; 116/306, 308, 309, 311, 312, 315, 318, 319, 320, 321, 323, 324, 327, 328

[56] References Cited

U.S. PATENT DOCUMENTS

| | | | |
|---|---|---|---|
| 332,208 | 12/1885 | Noel | 116/308 |
| 1,013,299 | 1/1912 | MacDonald | 40/5 |
| 2,066,183 | 12/1936 | Mehaffey | 116/308 |
| 2,587,147 | 2/1952 | Guion et al. . | |
| 3,604,134 | 9/1971 | Clark | 40/495 |
| 3,921,568 | 11/1975 | Fish . | |
| 4,323,609 | 4/1982 | Bromberg . | |
| 4,345,541 | 8/1982 | Villa-Real | 116/308 |
| 4,501,370 | 2/1985 | Kelley | 215/219 |
| 4,854,061 | 8/1989 | Khoshkish | 40/495 |
| 5,271,353 | 12/1993 | Besthorne . | |
| 5,377,614 | 1/1995 | Glazer . | |
| 5,447,769 | 9/1995 | Bromberg . | |
| 5,577,335 | 11/1996 | Tucker | 40/311 |

*Primary Examiner*—Andrew H. Hirshfeld
*Assistant Examiner*—R. A. Smith
*Attorney, Agent, or Firm*—Kolisch Hartwell Dickinson McCormack & Heuser

[57] ABSTRACT

A medication dosage reminder device includes a cruciform hub that attaches to a medication container and an annular dial that is pinned between the hub and the container but is otherwise free to rotate about the hub. The dial includes time of day indicia and the hub includes a co-operating pointer for selecting the time of day so indicated. A patient can rotate the dial about the hub to indicate the time at which the last dose of medication was taken or the time at which the next dose of medication is due.

11 Claims, 4 Drawing Sheets

MEDICATION DOSAGE REMINDER DEVICE

FIELD

The present invention relates to a device for reminding a patient to take his next dose of medication. More specifically, the invention provides a very simple clock-like visual representation of the time when the last dose was taken or the time when the next dose is due.

BACKGROUND

Modern medicine has produced a number of powerful and beneficial medications, including drugs to combat cystic fibrosis, heart disease, cancer, and AIDS. However, it is usually important that these drugs be taken at prescribed intervals; the drugs can be ineffective or even dangerous if taken at the incorrect time.

What is needed is a simple mnemonic device to remind patients when to take their medications. Such mnemonics are especially important for the elderly patient with failing memory or the AIDS patient who takes a large number of different medications.

Many such mnemonic devices exist in the art, including a number that represent an analogue clock having a manually operable dial or hands. Such devices do not seem to have become widely available and it is believed that the major shortcomings of such prior devices are undue complexity and cost of manufacture.

For example, U.S. Pat. No. 3,921,568 granted to William Joseph Fish on Jul. 25, 1973 for a, "Self Adhering Medication Time Reminder," describes a six part device mountable on a medication container. Some of these parts are made of plastic and some are made of metal. The rigid construction of the device permits it to engage only flat surfaces such as the top of a pill bottle lid, a location where it might be jarred or damaged when the patient removes the lid.

U.S. Pat. No. 4,345,541 granted to Antony-Euclid C. Villa Real for a, "Mono-Ringed Rotary Medication Reminder," has only two parts and replaces the medication container's existing cap. However, because medication containers have various shapes and sizes, a wide variety of such devices would have to be manufactured, and even then, the device would not be suitable for use on cardboard boxes, blisterpacks, or similar medication packaging.

U.S. Pat. No. 5,377,614 granted to Bradley M. Glazer on Jan. 3, 1995 for a, "Reminder Device for Pill Containers," describes an invention which has as many as nine parts, making it relatively expensive to manufacture. The complicated device provides information about day and month, which may often be unnecessary. Glazer's device is attached to the container cap with metal nails or tacks. These tacks might pull, might crack the hard plastic cap during installation, or might even destroy the seal of the container, rendering the device problematic for use with liquid medications.

U.S. Pat. No. 5,271,353 granted on Dec. 21, 1993 to Gerard Besthorne describes a clock-like device which is attached to the side of a medicine bottle by means of a V-notch cut in the back of the device and an elastic strap which encircles and engages the bottle. The device has eight parts and adds greatly to the overall size of the bottle, making it difficult or awkward to place the bottle in one's pocket or purse for use outside of the home.

A simpler device is described in U.S. Pat. No. 2,587,147 issued to Henry A. Guion and Evelyn Arnold. The device is a clock face with one hand turning on a metal stud or axle.

This simpler device has three parts but no obvious means of attachment to a medicine bottle. The device appears to be made of rigid material such as plastic and might not easily adhere to the curvilinear surface of a pill container.

What is needed is a device which is so simple in form and so cheap to produce that it could be economically inserted into a medication container by a pharmaceutical company or dispensed as a courtesy by a pharmacist with a prescription. The device should be so inexpensive that a patient would not hesitate to throw it out with the empty container and the pharmacological leaflet when his medication is finished. Ideally, this product would be made entirely out of sheet material, such as paper, cardboard or plastic, making production of the device more akin to publishing than to manufacturing.

The present invention is directed to such a device.

SUMMARY

The invention is a medication dosage reminder device constructed in two pieces from sheet stock such as paper, cardboard or plastic. The first piece is a hub having an indicator pointer. The second piece is an annular dial having clock markings. When the dial circumscribes the hub, the indicator pointer and the clock markings form a reminder indicating either the time at which the last dose was taken or the time at which the next dose is due. The hub may be adhesively fixed to a medication container such that the dial is free to rotate about the hub.

According to one aspect of the invention there is provided a device, mountable on a surface, for indicating the time at which a task was last completed or is next due, comprising: a sheet member having a central aperture and adapted to abut the surface; a hub having a diameter greater than the diameter of the central aperture of said sheet member; means for fixing a portion of said hub to the surface through the central aperture of said sheet member such that said sheet member is retained against the surface but is free to rotate about said hub and said fixing means; and co-operating indicia on said hub and said sheet member for indicating a time.

Preferably, said hub further includes a first pair of opposing protrusions extending radially outwards from the periphery of said hub and adapted to oppose the surface and to constrain said sheet member against the surface. Preferably, said hub further includes a second pair of opposing protrusions extending radially outwards from the periphery of said hub and adapted to oppose said first pair of opposing protrusions such that said sheet member is constrained between said first and second pairs of opposing protrusions.

Said sheet member and said first pair of opposing protrusions may be flexible.

According to another aspect of the invention, there is provided a device for indicating one member of a set, the device comprising: a sheet member defining a central aperture; a hub having: a central pivot having a diameter less than the diameter of the central aperture in said sheet member; a first pair of opposing protrusions extending radially outwards from the periphery of the pivot and having a span greater than the diameter of the central aperture in said sheet member; and a second pair of opposing protrusions extending radially outwards from the periphery of the pivot and having a span greater than the diameter of the central aperture in said sheet member, the second pair of opposing protrusions being deformable away from the plane of the pivot such that the first and second pairs of opposing protrusions define between them a discrete annular channel adapted to receive for rotation therewithin said sheet member such that the central aperture of the sheet member encircles the pivot; and co-operating indicia on the hub and the sheet member for indicating one member of the set.

Preferably, the co-operating indicia includes: an annular arrangement of set members on said sheet member and a pointer on the pivot of said hub adapted to point to any one of said set members. Alternately, the co-operating indicia includes: an annular arrangement of set members on the pivot of said hub and a pointer on said sheet member adapted to point to any one of said set members.

Preferably, the device further includes means for affixing said hub to a surface such that said sheet member may rotate thereabout. Alternately, the device further includes means for affixing said sheet member to a surface such that the pivot on said hub may rotate within the central aperture in said sheet member.

BRIEF DESCRIPTION OF THE DRAWINGS

These and other features, aspects, and advantages of the present invention will become better understood with reference to the following description, appended claims, and accompanying drawings where:

DESCRIPTION

Figure 1:
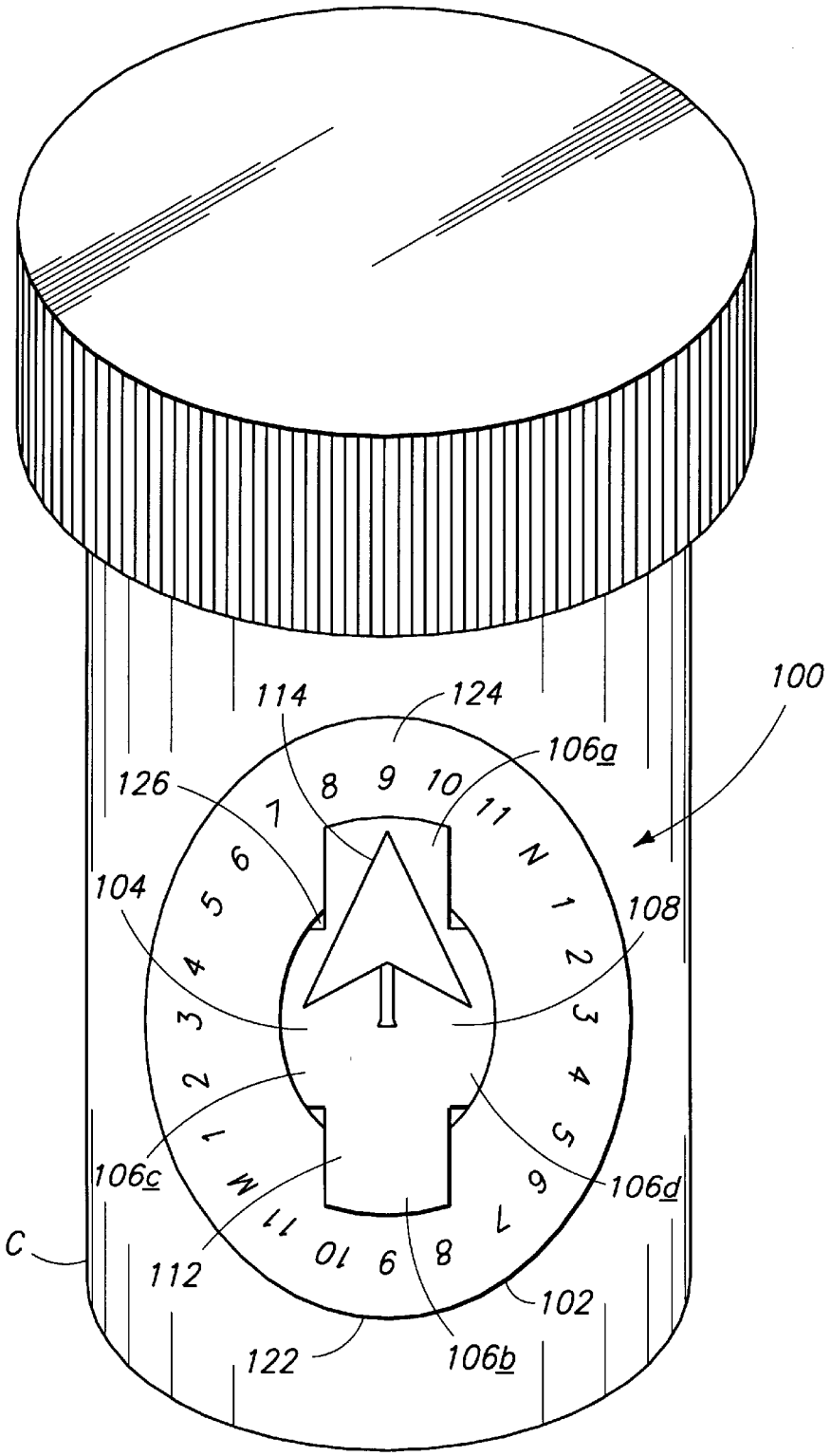
FIG. 1 is a perspective view of a medication dosage reminder device embodying a first aspect of the invention, the device being mounted to a medication container which is not part of the invention.
Figure 2:
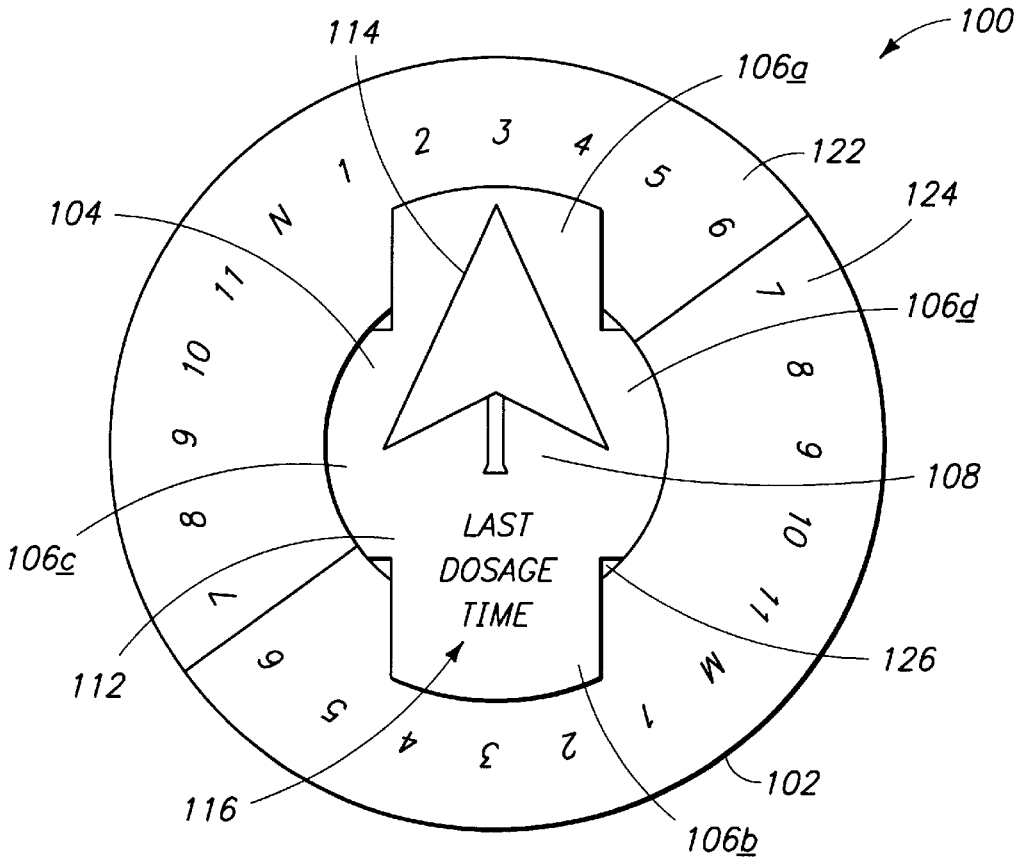
FIG. 2 is a front view of the device of FIG. 1.
Figure 3:
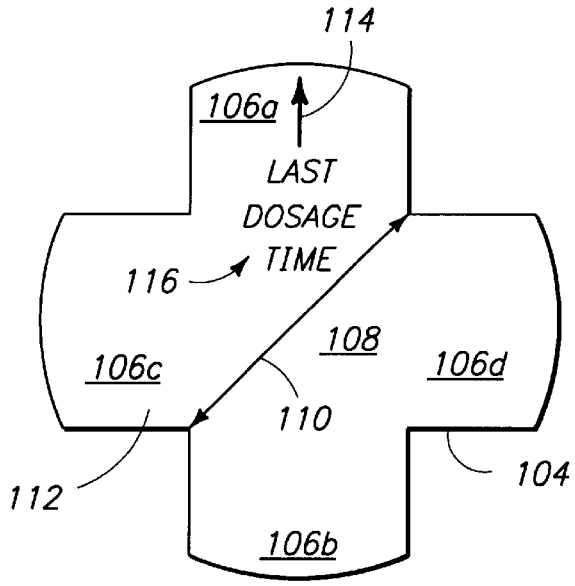
FIG. 3 is a front view of the hub of the device of FIG. 1.
Figure 4:
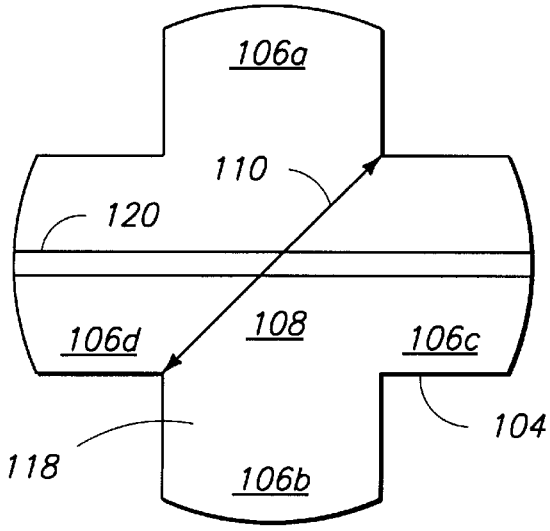
FIG. 4 is a rear view of the hub of the device of FIG. 1.
Figure 5:
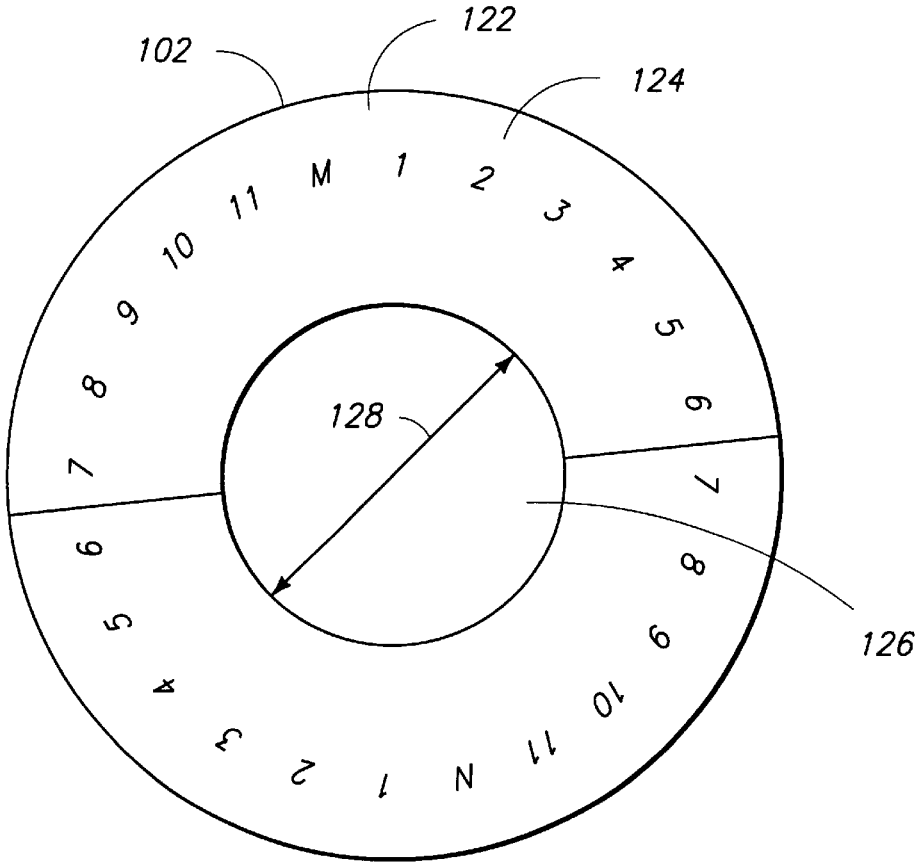
FIG. 5 is a front view of the dial of the device of FIG. 1.

With reference now to FIGS. 1 through 5, a medication dosage reminder device embodying a first aspect of the invention is generally illustrated at 100. The reminder device 100 is formed from two parts: an annular dial 102 and a cruciform hub 104. The dial 102 and the hub 104 are preferably formed from flexible sheetstock such as paper, cardboard, or plastic and may be punched, cut, or similarly formed; however, more rigid material or material otherwise formed would also work in many applications.

The hub 104 has two longitudinal tabs 106*a*, 106*b*, and two lateral tabs 106*c*, 106*d* which define at their intersection a pivot 108 having a diameter 110. Printed on the front surface 112 of the hub 104 and extending along the longitudinal tabs 106*a*, 106*b* is an arrow 114 accompanied by a legend 116, for example, "LAST DOSAGE TIME," or, "NEXT DOSAGE TIME." The rear surface 118 of the hub 104 retains a strip of adhesive 120 extending along the lateral tabs 106*c*, 106*d*. This adhesive strip 120 serves to attach the hub to a medicine container C, not part of the invention.

Printed on the front surface 122 of the dial 102 along its perimeter is a scale 124 representing time of day. The time scale 124 preferably includes indicia for clearly distinguishing A.M. from P.M. times. Substantially concentric with and defined within the annular time scale 124 is a central aperture 126 passing through the dial 102 and having a diameter 128 which is slightly larger than the diameter 110 of the hub 104.

In the device's 100 assembled configuration, the dial 102 is rotateably mounted on the hub 104, sandwiched between the tabs 106. Specifically, the front surface 112 of the lateral tabs 106*c*, 106*d* abuts the dial 102 and the rear surface 118 of the longitudinal tabs 106*a*, 106*b* abuts the dial 102 such that the dial 102 is locked onto the hub 104 but remains free to rotate about the pivot 108. Preferably the dial 102 and the hub 104 are somewhat frictional such that they will not rotate one their own accord but only under the control of the patient or some other user.

In use, the patient places a reminder device 100 on each of his medication containers C by securing the rear surface 118 of the hub 104 to the container C with the adhesive strip 120, the lateral tabs 106*c*, 106*d* embracing the container C and conforming to its exterior surface to increase the available mounting surface area. The patient then deforms the longitudinal tabs 106*a*, 106*b* in order to slip both of them through the central aperture 126 in the dial 102. By restoring the longitudinal tabs 106*a*, 106*b* to substantially their original orientation, the patient locks the annular dial 102 onto the pivot 108. After taking a dose of his medication at a prescribed time, the patient has two options. First, he might rotate the dial 102 until the hub 104 "LAST DOSE" indicator 114, 116 and the dial 102 time scale 124 indicate the time the current dose was taken. Subsequently, the patient could remind himself when he had last taken his medication and could calculate when to take the next dose. Second, the patient might use the device 100 to indicate the time for his next dose if, on taking the previous dose, he advanced dial 102 so the hub "NEXT DOSE" indicator 114, 116 and the time scale 124 indicate the correct time for the next dose.

Figure 6:
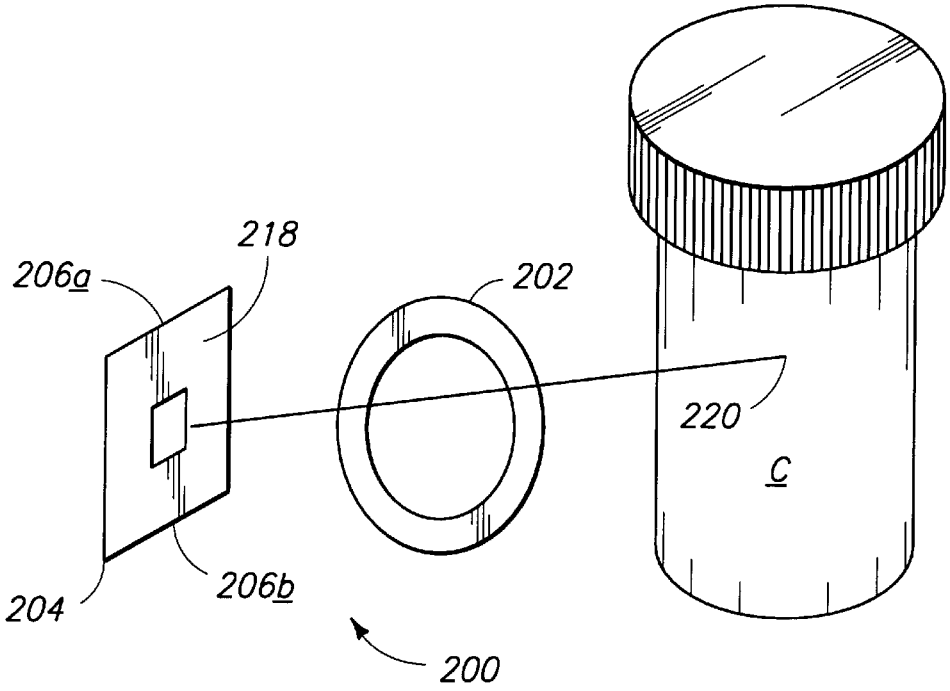
FIG. 6 is an exploded rear perspective view of a medication dosage reminder device embodying a second aspect of the invention.

With reference now to FIG. 6, a second embodiment 200 of a medical dosage reminder device is illustrated. In this second embodiment 200, the new hub 204 is similar to the original hub 104 except that the new hub 204 has two longitudinal tabs 206*a*, 206*b* but no lateral tabs. The annular dial 202 is adapted to be rotateably held against the medication container C, sandwiched between the rear surface 218 of the two tabs 206*a*, 206*b* and the container itself with the adhesive strip 220 replacing the pivot 108 found in the first embodiment. It can be appreciated that this second embodiment 200 might be simpler to manufacture and set-up than the first embodiment 100 but that the first embodiment 100 might be more robust because that pivot 108 keeps the dial 102 from slicing into the adhesive strip 120 and the lateral tabs 106*c*, 106*d* provide a larger surface area for engaging the container C.

Figure 7:
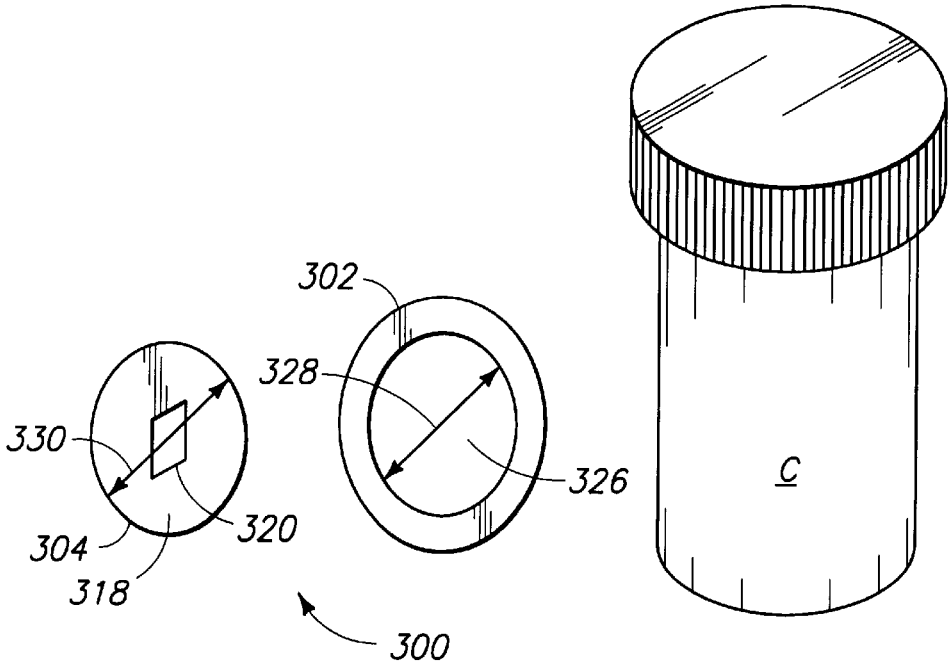
FIG. 7 is an exploded perspective rear view of a medication dosage reminder device embodying a third aspect of the invention.

With reference now to FIG. 7, a third embodiment 300 of a medical dosage reminder device is illustrated. In this third embodiment, the new hub 304 is similar to the original hub 104 except that the new hub 304 has no tabs but instead has a diameter 330 greater than the diameter 328 of the central aperture 326 in the dial 302. The annular dial 302 is adapted to be rotateably held against the medication container C, sandwiched between the rear surface 318 of the hub 304 and the container C itself with the adhesive strip 320 replacing the pivot 108 found in the first embodiment. It can be appreciated that this third embodiment has similar advantages and disadvantages as the second embodiment.

In either the second or third embodiment, the dosage reminder device 200, 300 would be installed by abutting the dial 202, 302 against a surface of the medication container C and then placing the hub 204, 304 over top of the dial 202, 302 such that the adhesive strip 220, 320 passes through the central aperture 226, 326 in the dial 202, 302 and engages the container C. This arrangement lends itself to mechanization such that the dosage reminder device 200, 300 could be attached during the medicine packaging or labelling process by a pharmaceutical company.

In these embodiments, the dosage reminder device 100, 200, 300 is preferably made of relatively flexible material. This characteristic and the relatively loose connection between the dial 102, 202, 302 and the hub 104, 204, 304 permits the dosage reminder device 100, 200, 300 to work even while wrapped around curved surfaces. Therefore, the dosage reminder device 100, 200, 300 might be placed on a medication bottle itself, instead of on the bottle cap, so that it is more visible and less subject to damage caused by manipulating a "childproof" push and twist cap.

Although a specific embodiment of the present invention has been described and illustrated, the present invention is not limited to the features of this embodiment, but includes all variations and modifications within the scope of the claims.

For example, the specific shape of the hub and dial may be varied so long as one is fixable to the medication container and the other can rotated thereabout while being otherwise retained in place. It is therefore contemplated that a different number or configuration of tabs could be used and that a different shaped aperture could be used.

It is also contemplated that the time indicia could be placed on the hub while the indicator arrow could be placed on the dial. The time scale might be set in minutes, hours, days, weeks, or any larger or smaller interval. It is still further contemplated that the device might find use in non-medical applications where tasks are repeated at intervals and a simple and handy reminder device would be of assistance. It is even further contemplated that a different scale might be used to represent members of a set other than the quantity time, for example people, places, or things.

Finally, it is contemplated that the adhesive strip could include any affixing means including various chemical adhesives, magnets, and mechanical couplers and fasteners.

The embodiments of the invention in which an exclusive property or privilege is claimed are defined as follows:

1. A device for indicating a medication time, the device comprising:

a. a medication container having a curved exterior side surface;

b. a sheet member defining a central aperture; and c. a hub mounted on the medication container and having:

i. a central pivot having a diameter less than the diameter of the central aperture in said sheet member, ii. a first pair of opposing protrusions extending radially outwards from the periphery of the pivot and having a span greater than the diameter of the central aperture in said sheet member, where the first pair of opposing protrusions deforms away from the plane of the pivot to conform to the curved exterior side surface of the medication container, iii. a second pair of opposing protrusions extending radially outwards from the periphery of the pivot and having a span greater than the diameter of the central aperture in said sheet member, the second pair of opposing protrusions being deformable away from the plane of the pivot such that the first and second pairs of opposing protrusions define between them a discrete annular channel adapted to receive for rotation therewithin said sheet member such that the central aperture of the sheet member encircles the pivot, and iv. co-operating indicia on the hub and the sheet member for indicating a medication time.

2. A device as in claim 1 wherein the co-operating indicia includes:

a. an annular arrangement of times on said sheet member; and b. a pointer on the pivot of said hub adapted to point to any one of said times.

3. A device as in claim 1 wherein the co-operating indicia includes:

a. an annular arrangement of times on the pivot of said hub; and b. a pointer on said sheet member adapted to point to any one of said times.

4. A device as in claim 1 wherein the hub is adhesively attached to the medication container.

5. A device as in claim 4 wherein the medication container is substantially cylindrical.

6. A method for indicating a medication dosage time, comprising:

a. providing a container of medicine, the container having a curved exterior surface;

b. providing a sheet member defining a central aperture;

c. providing a cruciform hub having a pair of opposing lateral tabs, a pair of opposing longitudinal tabs, and a central pivot with a diameter less than the diameter of the central aperture in said sheet member, where said sheet member and said hub include co-operating indicia for indicating a medication dosage time;

d. securing the hub to the curved exterior surface of said container such that said lateral tabs conform to the curved exterior surface of said container;

e. deforming said longitudinal tabs away from the plane of the central pivot;

f. placing said longitudinal tabs through the central aperture in said sheet member;

g. restoring said longitudinal tabs to substantially their original orientation to lock said sheet member onto said central pivot between said lateral tabs and said longitudinal tabs;

h. rotating said sheet member about said central pivot until the co-operating indicia indicate a desired medication time.

7. A method as in claim 6 wherein the step of securing includes securing the hub with adhesive.

8. A method as in claim 6 wherein the co-operating indicia includes:

a. an annular arrangement of times on said sheet member, and b. a pointer on the central pivot of said hub adapted to point to any one of said times.

9. A method as in claim 6 wherein the co-operating indicia includes:

a. an annular arrangement of times on the pivot of said hub; and b. a pointer on said sheet member adapted to point to any one of said times.

10. A method as in claim 6 wherein said step of securing is performed prior to said steps of deforming, placing and restoring.

11. A method as in claim 6 wherein said step of securing is performed subsequent to said steps of deforming, placing and restoring.

* * * * *